US005560303A

United States Patent [19]

Severin

[11] Patent Number: 5,560,303

[45] Date of Patent: Oct. 1, 1996

[54] DISMANTLEABLE STANDING TABLE

[76] Inventor: Werner Severin, Am Stadtwald 5a, 58739 Wickede, Germany

[21] Appl. No.: 389,350

[22] Filed: Feb. 16, 1995

[30] Foreign Application Priority Data

Feb. 22, 1994 [DE] Germany ..... 44 05 617.6

[51] Int. Cl.[6] ..... A47B 3/06

[52] U.S. Cl. ..... 108/158; 108/150; 248/188; 403/299

[58] Field of Search ..... 108/158, 150, 108/153, 157, 159; 248/188, 159; 403/299, 307

[56] References Cited

U.S. PATENT DOCUMENTS

| | | | |
|---|---|---|---|
| 450,603 | 4/1891 | Kuhl | 108/150 X |
| 2,315,608 | 4/1943 | Fergusson | 108/158 X |
| 2,529,780 | 11/1950 | Miller | 248/159 X |
| 2,782,085 | 2/1957 | Natale | 108/158 X |
| 3,391,660 | 7/1968 | Stewart | 108/153 |
| 3,438,342 | 4/1969 | Woolworth et al. | 108/158 X |
| 4,043,278 | 8/1977 | Kessler et al. | 108/157 X |
| 4,078,757 | 3/1978 | Waters | 108/150 X |

*Primary Examiner*—Peter M. Cuomo
*Assistant Examiner*—Janet M. Wilkens
*Attorney, Agent, or Firm*—Collard & Roe, P.C.

[57] ABSTRACT

A dismantleable standing table with a table top plate, a supporting construction on which the table top plate rests, and with a base support. The standing table has three parts, which are screwed to each other via screw connections which are detachable by hand without tools. There is a first top part comprising the table top plate, and a second center part comprising the supporting construction for the table top plate, this part includes a supporting inner tube which is concentrically received within an outer standing tube surrounding the inner tube. Furthermore, the standing table has a third bottom part including the base plate and possibly a step ring, this bottom part being connectable with the bottom end of the second part. For the screw connection among the three parts, it is possible to arrange, for example, top and bottom centering rings in the outer standing tube, such top and bottom rings each receive a threaded ring which is screwed to an outside thread of the inner tube.

6 Claims, 3 Drawing Sheets

DISMANTLEABLE STANDING TABLE

BACKGROUND OF THE INVENTION

1. Field of the Invention

The present invention relates to a dismantleable standing table with a table top plate, a supporting construction, on which the table top plate rests, and with a table base.

2. The Prior Art

Standing tables of this type are known and used, for example as party tables or the like. In most cases, these are round tables, of which the supporting construction is column like. The base of the table has to be relatively heavy in order to provide the table with adequate stability. A step ring, for example extending all around, can be mounted on the table base plate with a spacing from the floor, so that a person's foot can be comfortably placed on such a ring.

The known standing tables of the type specified above have the drawback that they are either not dismantleable or only with some difficulty, with the consequence that the standing table as a whole is bulky, and, therefore, difficult to transport in a passenger motor vehicle.

SUMMARY OF THE INVENTION

It is an object of the present invention to provide a dismantleable standing table, which, for transportation, can be dismantled quickly and simply into individual parts without the help of tools, which parts can be transported in a compact form.

The above object is achieved by a dismantleable standing table according to the invention wherein the standing table includes three parts, which are screwed together with each other by hand or by means of screw connections which are detachable without tools. Thus, there is a first top part comprising the table top plate, and a second center part comprising the supporting construction for the table top plate, with this construction comprising a supporting inner tube which is concentrically received within standing column like outer tube surrounding the inner tube, and a third bottom part comprising the base plate, which is connectable with the bottom end of the second center part.

Preferably, the table top plate has in the center a circular hole, which fittingly receives on its underside the top part of a threaded ring having an inside thread. This threaded ring is screwed together with a screw cap having an outside thread. This cap is shaped in the form of a mushroom with its head serving as an abutment for the threaded ring on the top side of the table top plate. Preferably, the outer standing tube, which may be made of plastic material, fittingly receives at the bottom and at the top a centering ring. Each one of the top centering ring and the bottom centering ring is screwed to the inner tube which is contained within the outer standing tube. In each case, the centering ring has a circular receptacle for a threaded ring. The connection between the outer standing tube and the table top plate is produced in that the top centering ring is screwed to the outer standing tube and the threaded ring is screwed to a screw cap, whereby the table top plate is clamped between the threaded ring and the screw cap.

The table top plate with the screw cap and the threaded ring thus form a first premounted unit. The outer standing tube with the inner tube and the two centering rings with one at the top and one at the bottom form the second premounted unit. The third premounted unit is preferably formed by a second threaded ring, which is rigidly connected with the base plate, and which can be screwed to the bottom end of the inner tube. In this way, it suffices for the dismantling to disconnect the screw connection between the top threaded ring and the inner tube, whereupon the table top plate can be removed from the outer standing tube. Next, it is possible to disconnect the screw connection between the lower end of the inner tube and the lower threaded ring, whereupon the outer standing tube can be removed from the base plate. Thereafter, the three individual parts of the dismantled standing table so obtained can be placed one on top of the other or adjacent to one another, and thus transported in a space-saving manner.

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

DETAILED DESCRIPTION OF PREFERRED EMBODIMENTS

Figure 1:
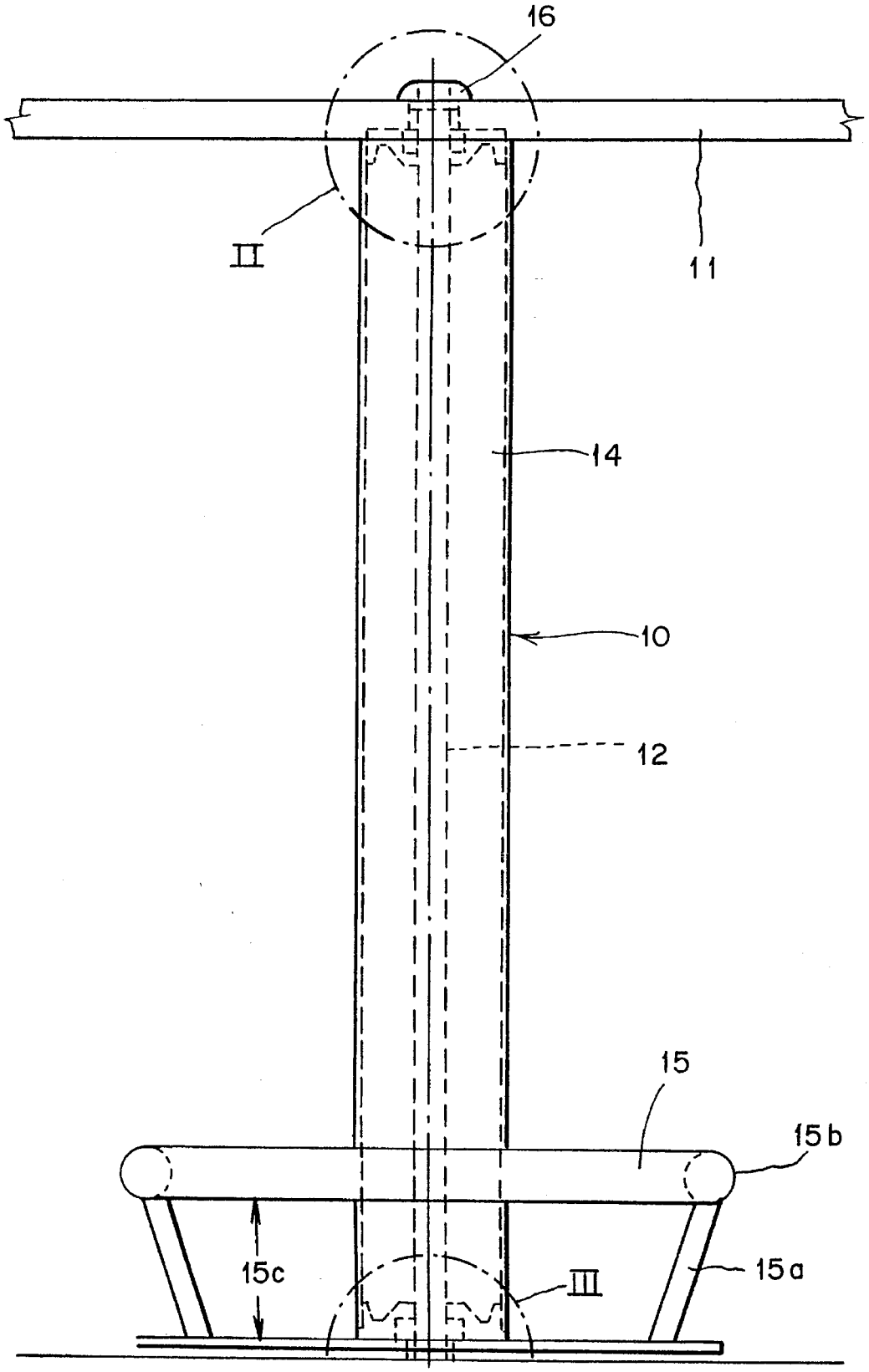
FIG. 1 shows a view of a standing table according to the invention.

Turning now in detail to the drawings, FIG. 1 shows that the standing table 10 according to the invention is a type of party table with a table top plate 11, a cylindrical column-like center standing outer tube 14 made of plastic, a horizontal base plate 13 with a relatively high weight, which provides the table with stability, and with a step ring 15 extending all around. This step ring has the stiffening struts 15*a* extending from the step ring to the base plate 13. A person standing on the table 10 can place his foot on the step ring 15.

According to the invention, the standing table is dismantleable by simple means without tools into three individual parts for space-saving transport, for example in a passenger motor vehicle. On the one hand, the table top plate 11 can be unscrewed, and the base plate 13 can be unscrewed on the other hand, leaving the tube-like standing column 14 as the third part.

Figure 2:
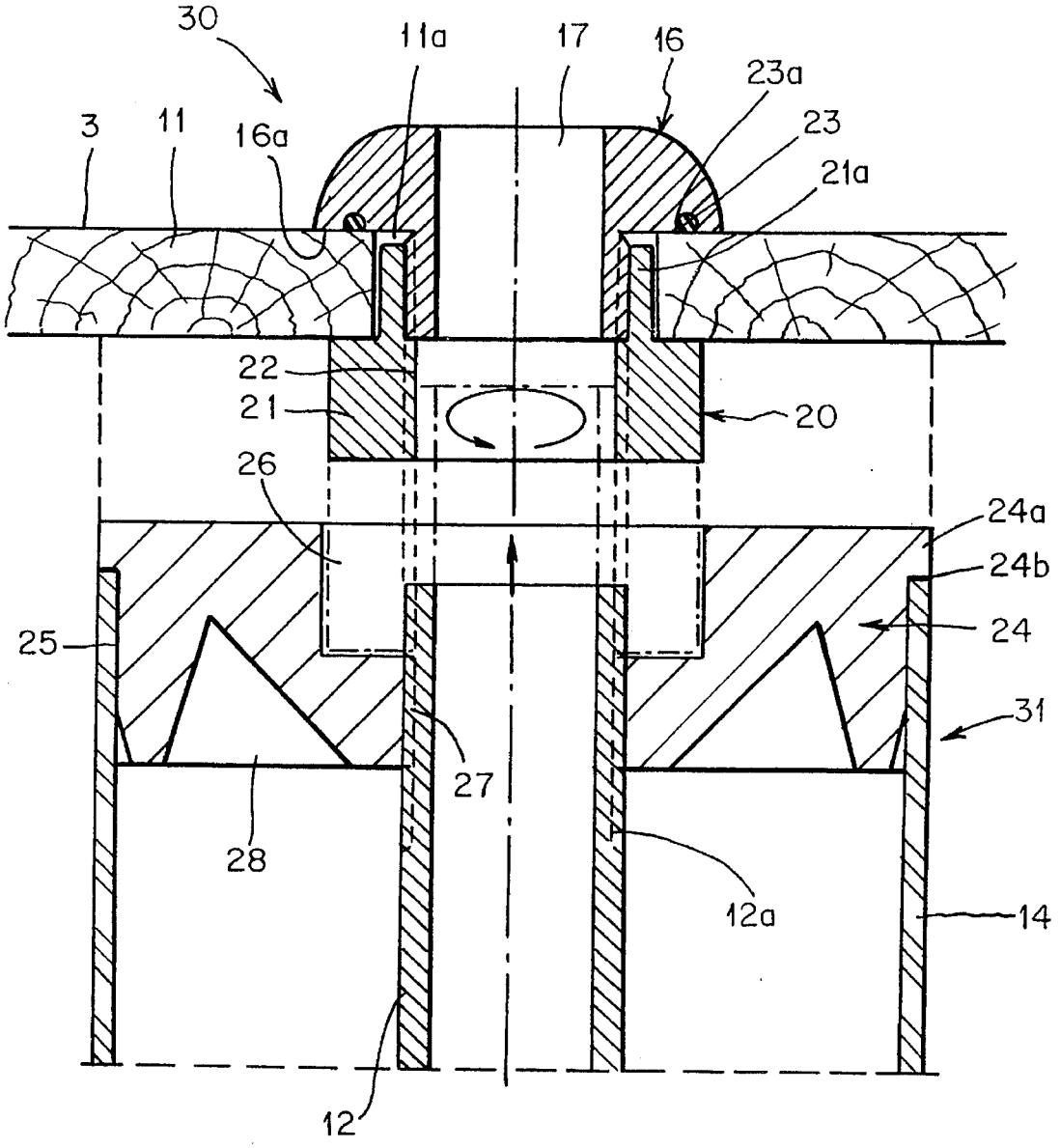
FIG. 2 shows a detail enlarged view of the center top zone of the standing table, with a vertical section of portion II of FIG. 1.

The connection of these three parts of the standing table of the invention with each other is explained in greater detail by reference to FIGS. 2 and 3. FIG. 2 shows that the standing table includes a first top part 30 comprising the table top plate 11, which has a circular hole 11*a* in the center, and this hole fittingly receives from the underside the top part of a top threaded ring 20 having the inside thread 22. This top threaded ring 20 has a wider bottom part 21 serving as an abutment on the underside of the table top plate 11, and which has a shoulder, so that the top part 21*a* of the threaded ring 20, which top part has a smaller outside cross section, is received in the opening 11*a*. However, the inside thread 22 extends across the total length of the top threaded ring 20. In the upper segment 21*a*, this inside thread 22 receives the outside thread of a screw cap 16 approximately having the shape of a mushroom. With its substantially flat underside 16*a*, the head of the screw cap 16 rests on the top side 3 of the table top plate 11 and serves as an abutment, so that when the parts are screwed together, the table top plate 11 is clamped between the screw cap 16 and the threaded ring 20. The head of the screw cap 16 has a groove 23*a* on the underside, which receives a sealing ring 23 for watertight sealing. Furthermore, the screw cap 16 has a concentric bore 17 extending through in the center, which, for example, can receive a sun umbrella (not shown), whose shaft can be plugged through the screw cap 16 and the threaded ring 20 and inserted in an inner tube 12. The inner tube 12 is concentrically disposed within the interior of the standing outer surrounding tube 14.

Figure 3:
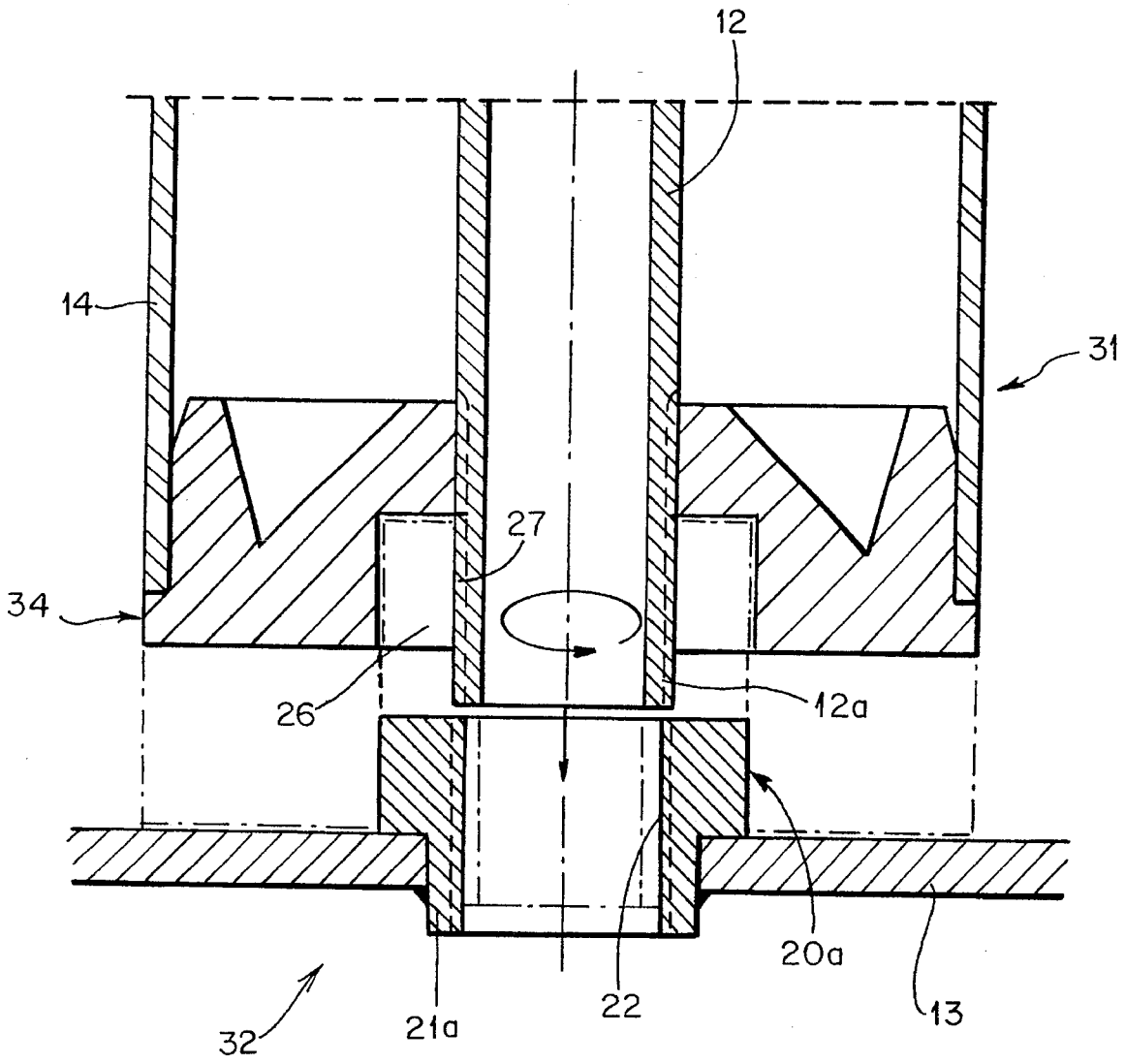
FIG. 3 shows a detail enlarged view of the center lower zone of the standing table with a vertical section of portion III of FIG. 1.

The second part 31 of the standing table according to the invention comprises the upright standing outer tube 14, the inner upright tube 12 being received within the outer standing tube, a top centering ring 24 being received by and surrounded by the standing outer tube, and a bottom centering ring 34 shaped in the same way, which is received within the standing outer tube 14 as well, but inverted 180° (see FIG. 3). The top centering ring 24 has at the top side a circular receptacle 26, which fittingly receives the lower projecting part 21 of the threaded ring 20. In the upper portion, the inner tube 12 has an outside thread 12*a*, and it projects a little vis-a-vis the bottom of the receptacle 26, so that it can be screwed to the remaining part of the inside thread 22 of the screw ring (see FIG. 2). The top centering ring 24 is seated in the outer standing tube 14 in such a way that it covers with a step 24*a* the top end 24*b* of the wall of the outer standing tube 14. The lower segment 25 of the top centering ring 24 has a slightly smaller outside diameter and is fittingly received in the interior of the outer standing tube 14. The recesses 28 of the top centering ring 24, which have a triangular cross section, only serve the purpose of saving material in the manufacture of the centering ring. Thus on the one hand, the top centering ring 24 is screwed with the inside thread 27 to the outside thread 12*a* of the inner tube 12, and the inner tube 12 is also screwed via the outside thread 12*a* to the threaded ring 20 via the inside thread 22 of the ring 20.

FIG. 3 shows that the bottom end portion 32 of the outer standing tube 14 receives in a similar way a bottom centering ring 34. However, the ring 34 has been inverted, so that the receptacle 26 now points downwardly and can in turn receive a bottom threaded ring 20*a* which, via its inside thread 22, can be screwed to the outside thread 12*a* of the slightly projecting inner tube 12. The bottom threaded ring 20*a* is again received in the receptacle 26 of the bottom centering ring 34. The bottom centering ring 34 is, in the same way as the top one, screwed to the inner tube 12 via its inside thread 27. The lower or bottom threaded ring 20*a* is fitted with its lower tapered segment 21*a* in a center opening of the base plate 13 and rigidly joined with the base plate, for example by welding. Hence the lower or bottom threaded ring 20*a*, together with the base plate 13 and the step ring 15, forms the third or bottom end part 32 when the standing table 10 is transported. The step ring is a spaced distance 15*c* above the base plate. Step ring 15 is maintained above base plate 13 by strut 15*a* which is attached at location 15*b* to step ring 15.

While one embodiment of the present invention has been shown and described, it is to be understood that many changes and modifications may be made thereunto without departing from the spirit and scope of the invention as defined in the appended claims.

What is claimed is:

1. Dismountable standing table comprising:

a first top part comprising a table top plate, said table top plate having in a center means defining a through-extending circular hole, a top threaded ring fittingly received in said circular hole from the underside, a top part of said threaded ring having an inside thread, whereby said threaded ring is screwed to a screw cap with an outside thread, a head of said screw cap serving as an abutment for the threaded ring on the top side of the table top plate, and a top centering ring having on the top side a circular receptacle for fittingly receiving a lower part of the threaded ring;

a second center part comprising a supporting construction for the table top plate, said construction comprising a supporting inner tube concentrically within a standing outer tube surrounding said inner tube;

and said top centering ring having an inside thread screwable to an outside thread of the inner tube concentrically within the standing outer tube;

a third lower part comprising a base plate, said base plate being connectable with a lower end of said second center part, said outer standing tube of said second part fittingly receives at the top said top centering ring, and the standing outer tube receives in the lower end a bottom centering ring;

said bottom centering ring in the lower end of the standing outer tube having a receptacle pointing downwardly and adapted for fittingly receiving a bottom threaded ring;

a bottom threaded ring being rigidly joined with the base plate, and said threaded ring having an inside thread and being screwable to a matching outside thread of a lower segment of the inner tube;

whereby the standing table has three parts screwable to each other via screw connections detachable by hand without tools.

2. Dismantleable standing table according to claim 1, wherein the screw cap is mushroom-shaped.

3. Dismantleable standing table according to claim 1, further comprising:

a bottom part comprising the base plate having a step ring extending concentrically all around the outer standing tube and being a spaced distance above the base plate.

4. Dismantleable standing table according to claim 1, wherein the screw cap has a concentric bore extending through in the center for receiving a shaft of a sun umbrella.

5. Dismantleable standing table according to claim 1, wherein the head of the screw cap has a groove on the underside for receiving a sealing ring.

6. Dismantleable standing table according to claim 1, wherein the threaded ring has a wider bottom part serving as an abutment on the underside of the table top plate and having a shoulder upper part of the threaded ring having a smaller outer cross section, such that the shoulder is received in the circular hole of the table top plate.

* * * * *